United States Patent [19]

Pennock

[11] 3,943,725

[45] Mar. 16, 1976

[54] APPARATUS FOR GUIDING A LOAD BETWEEN A SURFACE APPARATUS AND A SUBMERGED BASE PLATFORM

[75] Inventor: Michael Derek Pennock, Pinner, England

[73] Assignee: Subsea Equipment Associates, Ltd., Hamilton, Bermuda

[22] Filed: Sept. 3, 1974

[21] Appl. No.: 502,311

[30] Foreign Application Priority Data

Sept. 3, 1973 France ..... 73.31692

[52] U.S. Cl. ..... 61/46.5; 61/69 A; 166/.5

[51] Int. Cl.[2] ..... E02D 27/52; E21B 43/01

[58] Field of Search ..... 61/69, 46.5, 72.3; 166/.5, 166/.6; 175/7

[56] References Cited

UNITED STATES PATENTS 3,021,909 2/1962 Postlewaite ..... 166/.5 X 3,191,696 6/1965 Pollard et al. ..... 166/.5 X

*Primary Examiner*—Jacob Shapiro

*Attorney, Agent, or Firm*—Sughrue, Rothwell, Mion & Zinn

[57] ABSTRACT

Apparatus for guiding a load between a surface apparatus and a submerged base platform comprises at least two return pulleys mounted on the base platform, at least two cables passing over the pulleys, one run of each cable being connected to the surface apparatus by a winch and the other run acting as a guide for a load carrier, each run passing from the respective pulley to the respective winch separating from the respective guide run as it extends away from the respective pulley and the runs connected to the load carrier being orientated by the latter in the direction of the surface apparatus, and means for horizontally levelling the load carrier.

9 Claims, 11 Drawing Figures

APPARATUS FOR GUIDING A LOAD BETWEEN A SURFACE APPARATUS AND A SUBMERGED BASE PLATFORM

The invention relates to an apparatus for guiding loads between a boat or any other surface apparatus and a sub-marine floor, particularly but not exclusively for use in oil-drilling.

Known guiding systems, connecting a drilling head to a surface apparatus, generally include a fixed assembly or base platform situated at the bottom of the water and cable lines connecting this base platform to the surface apparatus. Lowering of material on to the base platform is done by means of a load-carrier equipped with fastenings sliding along each line and by controlling the lowering motion by means of a winch supporting the load-carrier. Systems of this type do not present any major problem in shallow water. On the other hand, as soon as the depth at which the base platform is situated becomes considerable, it becomes difficult, for example because of the length of the anchor lines of the boat, to immobilize the boat completely in all directions so that the guide lines connected, for example, to the chain-locker of the boat, end up in certain cases by meeting and even winding round each other, preventing the loads from being lowered on to the platform. The disadvantage remains even when dynamic anchoring is used, particularly as the boat is often required by the working conditions to change course, if only to find the best orientation relative to both the wind and the swell.

Moreover, in the case of an unforseeable accident, e.g. the arrival of an iceberg if drilling is carried out in a region of low latitude, or the untimely eruption of the well, it is impossible to instantaneously sever the connection formed by the guide lines in order to enable the boat to depart rapidly from the scene without avoiding the subsequent loss of the guide-lines.

According to the present invention there is provided apparatus for guiding a load between a surface apparatus and a submerged base platform comprising at least two return pulleys mounted on the base platform, at least two cables passing over the pulleys, one of the runs of each cable being connected to the surface apparatus by means of a winch, the other run acting to guide a load-carrier, and means for horizontal levelling of the load-carrier, each run passing from the respective pulley to the respective winch separating from the respective guide run as it extends away from the respective pulley and the runs connected to the load-carrier being orientated by the latter in the direction of the surface apparatus.

Thus, even in the case of a pronounced change in the orientation of the boat or other surface apparatus, the divergent runs passing from the base platform pulleys to the surface winches cannot meet the guide runs, no matter at what depth the load-carrier is situated. As the winches haul the load-carrier downwards via the pulleys fixed to the base platform, no, even pronounced, variation in the orientation of the boat can prevent the load-carrier from descending to its base platform and applying itself there perfectly. Moreover, by simple unwinding of the cables and by the provision of a suitable marker-buoy, brought into play by release of the ends of the runs situated on the winches, separation of the ends of the divergent runs from the surface apparatus permits rapid separation of the guiding apparatus from the surface apparatus, while retaining the possiblility of very easy retrieval of these runs. As regards the other two runs, these may also receive a buoy when their ends are not attached to the load-carrier, or else co-operate by their position with means for recovery of the load-carrier and the platform.

The apparatus may thus also include means for automatically releasing marker-buoys on release of the ends of the divergent cable runs from the surface apparatus, the other runs co-operating with means for recovery of the load-carrier.

The means for horizontal levelling of the load-carrier may include means for interlocking the divergent runs, so that, under the effect of their being interlocked, the load-carrier will retain its horizontal trim throughout the whole of its travel.

It is therefore sufficient to ensure the horizontal trim of the load-carrier to retain it upon application of the horizontal base of the latter to the base platform, whatever may be the momentary differences in tension acting on the drive portions of the runs, it being possible to compensate for these tension variations by the use of constant-tension winches.

The means for interlocking the divergent runs may be combined with means for interlocking at least one of the divergent runs with a drum tensioning a cable, one end of which is attached to a point on the said platform such that this cable separates from the guide runs as it approaches the surface apparatus.

It is therefore suficient, after setting the load-carrier in horizontal trim, to set in action the means interlocking this latter cable with one of the divergent runs of which the movements are synchronised to render the load-carrier insensitive to the movements of the surface apparatus, the means for interlocking the divergent runs combined with the means for interlocking of the cable attached to the base platform and to the means for horizontal levelling of the load-carrier, acting as an impact-prevention means.

The invention will be more clearly understood from the following description of embodiments thereof, given by way of example only, with reference to the accompanying drawings, in which.

Figure 1:
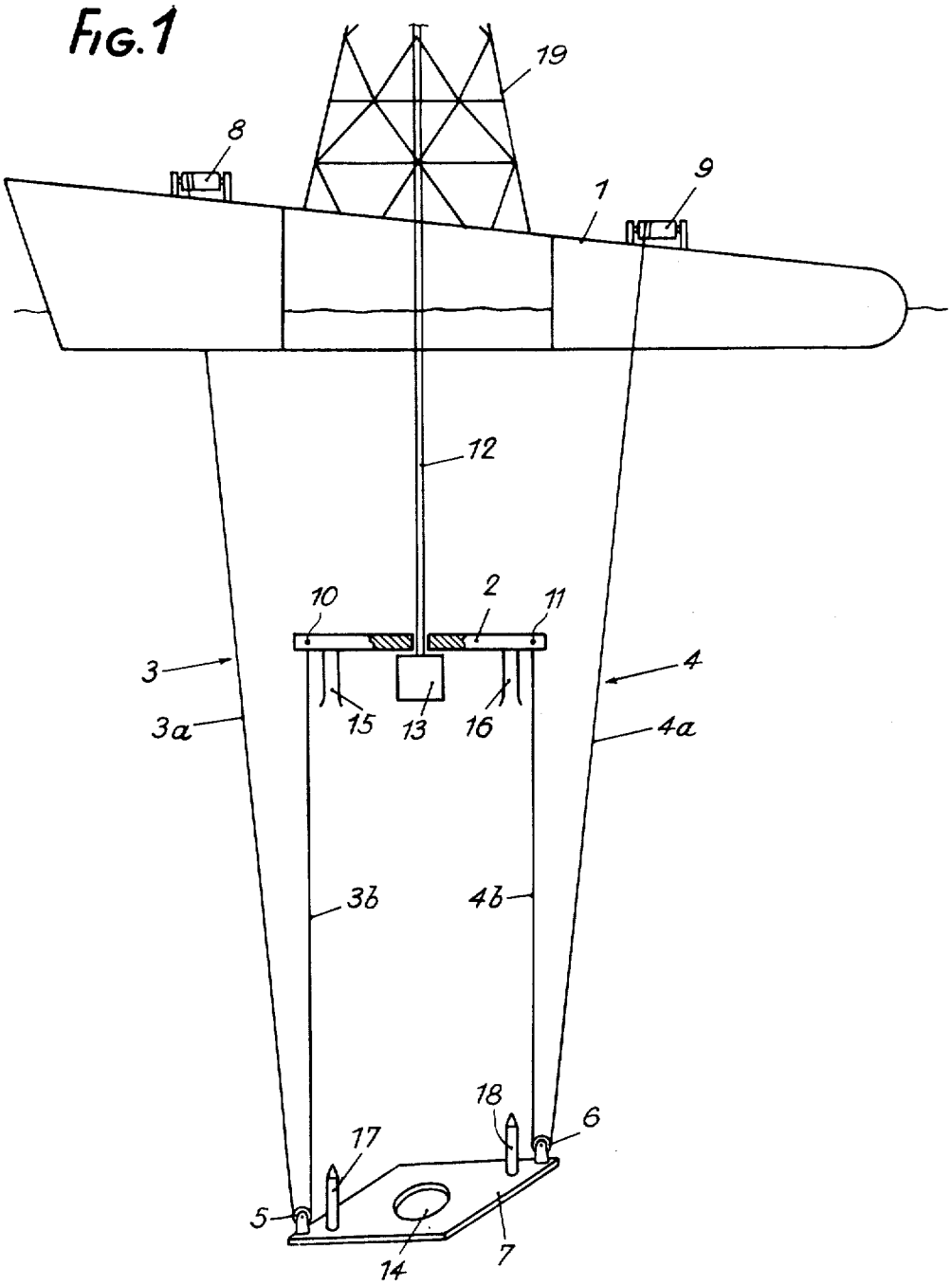
FIG. 1 is a diagrammatic view of an embodiment of the guiding apparatus according to the invention.

Although FIG. 1 shows the diagrammatic view of a drilling boat 1, it will be appreciated that this boat may be replaced by any surface apparatus of which the anchoring may be of any type and in particular dynamic. A load-carrier 2 is manoeuvred by means of only two cables 3 and 4, each of which passes over a respective pulley 5 and 6 firmly attached to a base platform 7, which has been shown in perspective to facilitate understanding of the drawing. Cable runs 3*a* and 4*a*, respectively connecting pulleys 5 and 6 to winches 8 and 9 on the boat 1, are divergent upwardly so that despite any momentary variation in the orientation of the boat, these runs cannot foul cable runs 3*b* and 4*b* leading from pulleys 5 and 6 to attachment points 10 and 11 on load-carrier 2. As shown, winches 8 and 9 are being operated to lower a load 13 supported by rod string 12 and guided laterally by load-carrier 2. Load 13 may for example be a particular assembly of a well-head for fitting to the drilling head, which is not shown, but suggested by opening 14 in platform 7. In order to provide efficient guiding at the approach to the platform, the load-carrier 2 is provided with hollow reception cylinders 15 and 16 terminating in frusto-conical surfaces designed to facilitate penetration therein of guide columns 17 and 18 when the load-carrier approaches platform 7.

The means for manoeuvring rod string 12 from derrick 19 have not been shown, as they are already known and may be of any kind, no particular adaptation being necessary when they are used with the guiding apparatus. Winches 8 and 9 are constant-tension winches in order to avoid any inopportune strains as the loads are set in position on base platform 7. However, it will be noted that the positions of the winches are such that runs 3*a* and 4*a* are divergent towards the surface of the water. Preferably, the mounting of pulleys 5 and 6 is such that they can rotate about a vertical axis, so that in the case of a variation in the orientation of boat 1, which is supposed dynamically anchored, for example, this variation does not cause disengagement of the cables. In this example, special means have not been shown for placing the load-carrier in a position of horizontal trim, since this means is supposed as formed by rod string 12 and load 13, the latter directly supporting load-carrier 2. The passage formed in load-carrier 2 permits free rotation of the rod string.

Figures 2, 3, 4, 5:
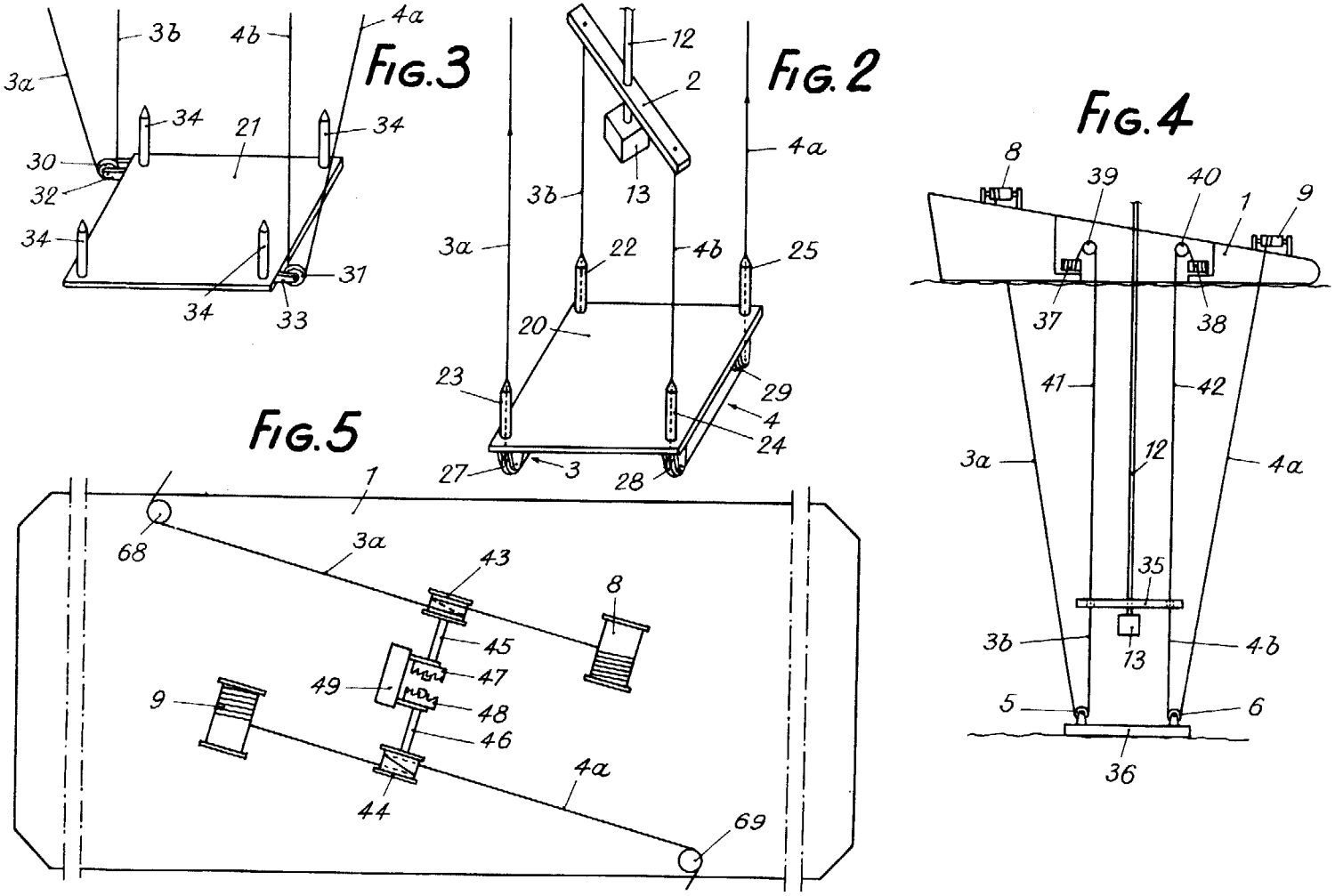
FIGS. 2 and 3 show two embodiments of base platforms provided with guiding means.
FIG. 4 is a diagrammatic view of a modification of the guiding apparatus.
FIG. 5 is a plan view of means for interlocking the divergent cable runs of the guiding apparatus.

FIGS. 2 and 3 show two other base platforms 20 and 21 and in which the same numerical references have been used for runs 3*a*, 4*a*, 3*b* and 4*b* of the two cables as are used in FIG. 1.

In the embodiment of FIG. 2, platform 20 is provided with four columns 22, 23, 24 and 25 through which pass respectively runs 3*b*, 3*a*, 4*b* and 4*a*. Pulleys such as the visible pulleys 27, 28 and 29 return cables 3 and 4. In this example, the pulleys may keep a fixed position, as the runs which they subtend always have the same orientation.

In the embodiment of FIG. 3, return pulleys 30 and 31 of cables 3 and 4 are mounted on external supports 32 and 33, permitted sufficient separation of the cables and columns 34 for these to be used by the load-carrier or possibly by the load itself.

The embodiment shown in FIG. 4 differs from that of FIG. 1 by the addition of winches 37 and 38 acting to pull on cables 41 and 42, the ends of which are fixed to load-carrier 35, as are the ends of runs 3*a* and 3*b*. Return pulleys 39 and 40, mounted on vessel 1, determine the spacing of the cables 41, 42 which are positioned vertically above runs 3*b* and 4*b*. Cables 41 and 42 may be used for two purposes. They may be used to ensure the horizontal trim of loadcarrier 35, and as means for recovering the load-carrier. It will be observed that during the raising of load-carrier 35, the latter is pulled, so that the benefit of efficient guiding will be obtained whatever may be the variations in the orientation of the boat on lowering or raising of the load-carrier, even when load 13 is deposited on the platform and rod string 12 is raised alone. After recovery of load-carrier 35, the ends of runs 3*b* and 4*b* may be detached and connected to marker buoys and the same may be done for the ends of the still wound portions of runs 3*a* and 4*a*, as will be described below with reference to FIG. 9, when for any reason the boat must depart rapidly from the location of the base platform.

Assuming that the load-carrier 2, FIG. 1, or 35, FIG. 4, has been brought into a position of horizontal trim, this trim being attained by any means and in particular as a result of the presence of rod string 12, which is maintained in a vertical position and co-operates with load-carrier 2 or 35. As soon as this trim has been obtained, it may be maintained using the means shown in FIG. 5 which shows the arrangement of winches 8 and 9 on the deck of boat 1. Each run 3*a* and 4*a* passes helically round a drum 43 or 44, on which it is one turn of each run is wound. The shafts 45 and 46 of these drums, as they rotate, drive clutch pieces 47 and 48 which can move towards each other under the control of an engagement and disengagement means 49. When the load-carrier 2 or 35 is in horizontal trim, means 49 is operated so that clutch pieces 47 and 48, provided for example with clutch teeth, are applied against each other. Shafts 45 and 46 being thus angularly fast, the cable lengths unwound by winches 8 and 9 are constant, so that the horizontal trim of the load-carrier is maintained during the whole travel of load 13.

Figure 6:
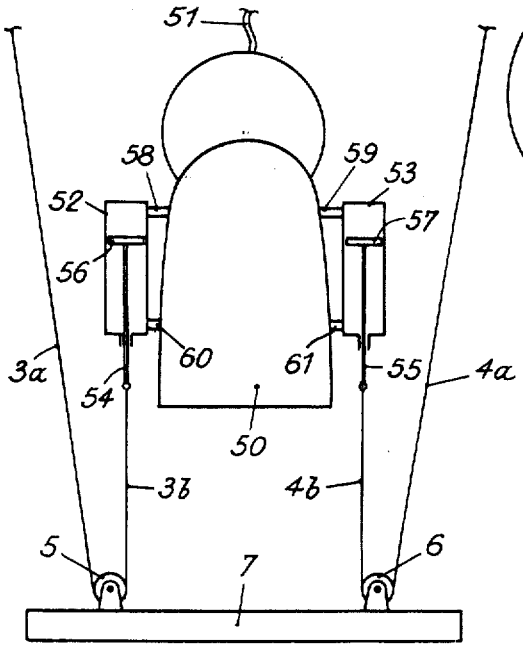
FIG. 6 is a diagrammatic view of a means for horizontal levelling of the load-carrier.

The load-carrier may be of any type. In particular, as shown in FIG. 6, it may be a diving-bell 50, connected to the surface by an optionally supporting conduit 51 containing all the conductor cables and auxiliary channels. This bell, which may be of any required type, may in particular adopt a positive buoyancy as shown in the Figure. As the means for obtaining the horizontal trim are no longer provided by the verticality of the rod string, the trim is obtained using two cylinders 52 and 53 rigidly attached to bell 50, the ends of rods 54 and 55 of the pistons 56 and 57 of which are connected to runs 3*b* and 4*b*. Conduits 58 and 61, optionally acting as supports, serve the chambers of cylinders 52 and 53 and are connected to hydraulic circuits of the bell in order to vary the positions of these pistons relative to each other and consequently the inclination of the bell.

Figure 7:
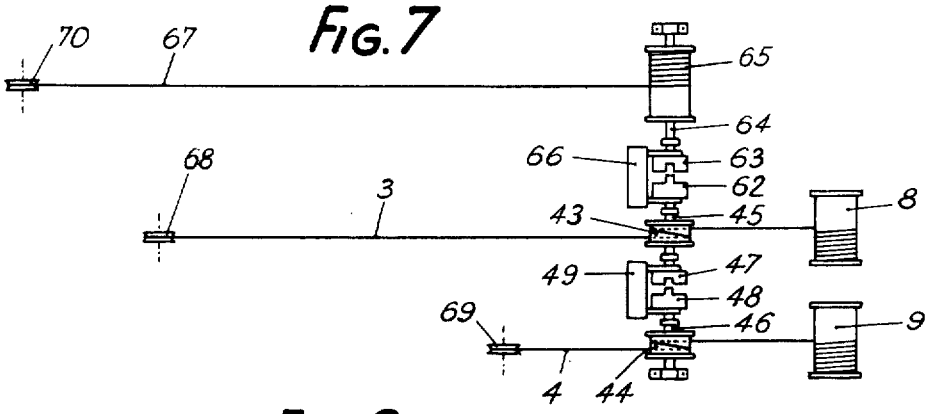
FIG. 7 is a diagrammatic plan view of means for interlocking the cables of FIG. 5 with an auxiliary traction cable.
Figure 8:
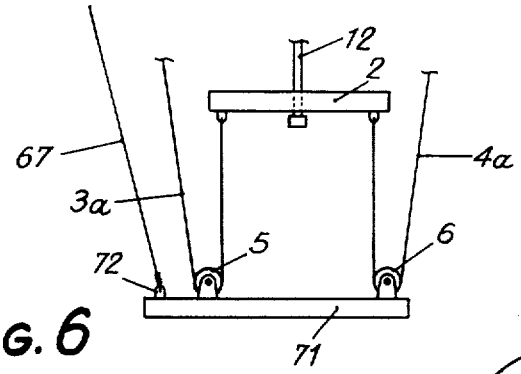
FIG. 8 is a diagrammatic elevation of the lower portions of the cables of FIG. 7.

As the elimination of the rod string has necessitated the addition of a means for providing horizontal trim, perfect operation of the guiding apparatus dispite possible tension variations in runs 3*a* and 4*a* is ensured by combining the apparatus for synchronization of the unwinding of runs 3*a* and 4*a*, comprising the control means 49 of clutch pieces 47 and 48 interlocking drums 43 and 44 with a second synchronization apparatus as shown in FIGS. 7 and 8. Shaft 45 of drum 43, FIG. 7, is extended on the side opposite to clutch piece 47 and includes another clutch piece 62 engaging with clutch piece 63 mounted on the shaft 64 of a drum 65 under the control of an engagement means 66. Drum 65 carries a cable 67, of which one end is attached to platform 7, FIG. 8, at a point 72 sufficiently distant from pulleys 5 and 6 to avoid any hindrance to the conveyance of loads. The positions of winches 8 and 9 have been made different from those shown in FIG. 5, simply in order to facilitate understanding of the operation of the impact-prevention apparatus created by the combination of the apparatus for synchronisation and levelling in a horizontal position of the load-carrier.

Assuming that load-carrier 2 or bell 50 has been brought into horizontal trim and that clutch pieces 47 and 48 have been engaged by means of control means 49. It is then sufficient, after tensioning cable 67, to operate engagement means 66 to interlock the shaft 64 of drum 65 with the shaft 45 of drum 43 by coupling clutch pieces 62 and 63. Thus, unwinding of cables 67, 3 and 4 is effected in synchronisation, the quantities of cable unwound being identical because of the synchronised rotation of shafts 45, 46 and 64. Even if during lowering of a load one of the cables happened to slacken slightly for any reason, as the horizontal trim of the load-carrier or bell 50 is retained due to the means employed, particularly pistons 56 and 57, FIG. 6, ensuring the constant tension of runs of similar length, cable 67 would finally be wound at the horizontal approach of bell 50 and platform 7 until the perfect application of the bell on the latter.

If necessary, the boat or other surface apparatus may be separated rapidly from the guiding apparatus, since it is sufficient to release the cables held by the winches and drums of the apparatus. Advantage is taken of this fact to incorporate in the apparatus means for marking the cables employed, by passing each cable, for example cable 3, FIG. 9, into a frusto-conical guiding apparatus 73 and into a clamping device 79, 80 firmly attached to a float 76. Guiding apparatus 73 is retained by locking means 74 firmly attached to the boat and capable of being operated automatically to release the guiding apparatus 73 to which float 76 is connected by means of chains 82. It is therefore sufficient to allow the cable to unwind and then to release guiding apparatus 73 by the operation of locking means 74 to cause both the separation of the load guiding apparatus from the boat and the bringing into play of the guide cable marking means, permitting easier recovery because the cables are still returned by pulleys 5 and 6.

By way of example and as shown, the locking means 74 may consist of springs 74 acting on locking fingers 75. The springs 74, which are capable of holding apparatus 73 by means of fingers 75 in spite of the weight of float 76, give under the traction applied by cable 3 when the latter, pulling with it the attachment 81 fixed to its end, jams the latter in the inside part of guiding apparatus 73. The force of these springs and the inclination of conical surface 73 to the vertical are sufficiently small, however, not to cause the breakage of attachment 81 on impact and the release of the assembly of apparatus 73, cable 3 and float 76. When this assembly falls into the water, cable 3 continues to drop and projects the lower portion of guiding apparatus 73 against piece 80 of the clamping device formed by vertical pieces 79 and 80, held by connecting rods 78 and between which cable 3 passes. As float 76 and cable 3 apply forces to pieces 79, 80 in opposite directions, apparatus 73 therefore causes the jamming of cable 3 in the clamping device.

It is therefore sufficient to use the means described above for each of the cables and to allow their unwinding to automatically cause both the separation of the load guiding apparatus from the boat and the bringing into play of the means for marking the guide cables permitting recovery. This latter is made easier because, as previously stated, as the cables are still returned by pulleys 5 and 6 attached to platform 7. Thus advantage is taken of this fact to use at least one of the runs as a guide line for a pick-up means.

Figure 10:
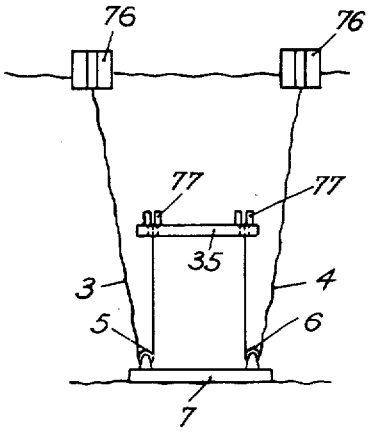
FIG. 10 is a diagrammatic view of the apparatus after release.

It will be noted that floats 77 may also be added to load-carrier 35, FIG. 10, to tension the cable of which one end is retained by floats 76, as disclosed above.

Figure 9:
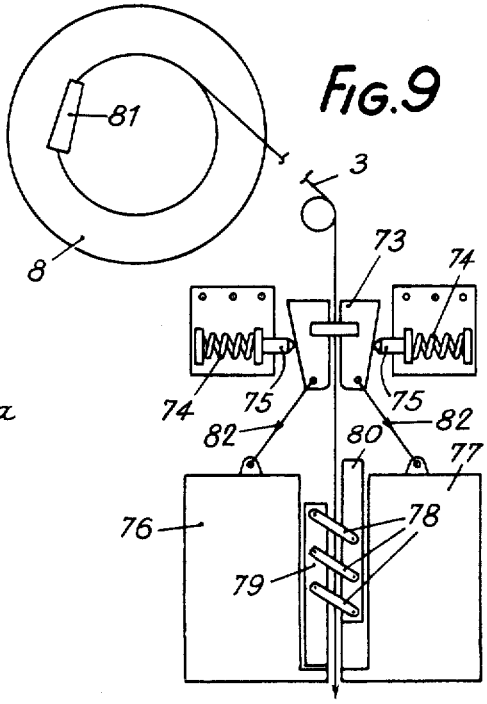
FIG. 9 is a diagrammatic elevation of apparatus for release of the ends of the divergent cable runs from the surface apparatus.

In particular, where the embodiment selected is that of FIG. 4, i.e. where, in addition to cables 3 and 4, cables 41 and 42 are available, wound on winches 37 and 38, on each cable run there may be provided an attachment 81 which, in the case of release of the load-carrying apparatus from the boat 1, would cause the release of four floats identical to floats 76 of FIG. 9. It is therefore easy to effect the recovery of load-carrier 35 and to return it to service.

Figure 11:
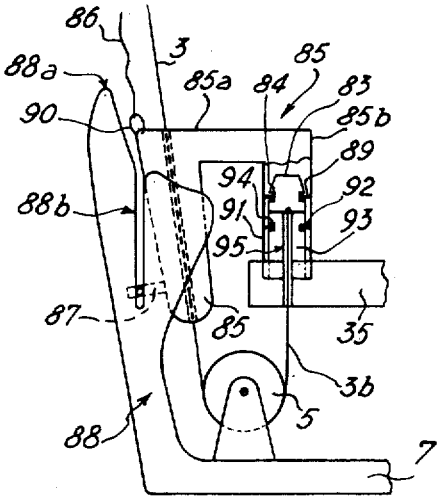
FIG. 11 is a diagrammatic view of an apparatus for recovery of the load-carrier.

In order to facilitate recovery of the load-carrier after its forced release, means may be provided on the load-carrier which can lock on to conventional pick-up tools. By way of example, FIG. 11 shows diagrammatically a portion of load-carrier 35 nd platform 7, as well as pulley 5 and cable 3, load-carrier 35 being equipped with a spindle 93 bearing a groove 94. Spindle 93 has an axial channel 95 acting as a passage for cable 3, the end of which is attached to a retaining piece 83 bearing a groove 84. When cable 3 is tensioned, piece 83 rests on spindle 93 rigidly attached to load-carrier 35. A pick-up tool 85, fixed to a retaining cable 86 by ring 90, is provided with an internal channel in which cable 3 is threaded. It slides on the latter until a horizontal guiding arm 87 impinges against the upper edge **88*a* of a guide surface 88 rigidly attached to platform 7. Sliding on this surface, arm 87 positions itself and falls into a vertical slot 88*b* which is so shaped that it enables the edge of cylinder 85*b* of piece 85 to fit over piece 83 and actuate a locking apparatus 89, a spring for example, entering slot 84. This locking then enables pick-up tool 85 and run 3*b* to be firmly attached. It is then sufficient to release cable 3 and to pull the tool by means of cable 86 to recover run 3*b* at the surface. It is self-evident that spring 89 may be calibrated to break automatically in the case of a normal resistance due to accidental damage to the load-carrier, or else include a controlled breakage means to recover only tool 85.**

When it is also required to recover load-carrier 35, to the lower portion of the locking cylinder **85*b* of the tool is fixed a sleeve 91 carrying a locking spring 92. Upon descent of the guiding arm 87 of tool 85 to the bottom of vertical slot 88*b*, locking means 92 enters grove 94 of spindle 93 rigidly attached to load-carrier 35. By using an identical tool around cable 4, load-carrier 35 can thus be surfaced by means of cables 36, after release of cables 3 and 4.**

It is self-evident that as the pick-up tools and guide pieces are conventional tools, these means may be of any type from the moment when the pick-up piece sliding on a cable run connecting the surface to a pulley of the platform co-operates with the guide surface to cause its appropriate positioning on the locking piece rigidly attached to the load-carrier.

What is claimed is:

1. Apparatus for guiding a load between a surface apparatus and a submerged base platform comprising at least two return pulleys mounted on to the base platform, at least two cables passing over the pulleys, one of the runs of each cable being connected to the surface apparatus by means of a drum driven by a winch, wherein each cable passes around a drum, the shafts of which are interconnected by clutch means, the other run acting to guide a load-carrier, and means for horizontal levelling of the load-carrier, each run passing from the respective pulley to the respective winch separating from the respective guide run as it extends away from the respective pulley and the runs connected to the load-carrier being orientated by the latter in the direction of the surface apparatus.

2. Apparatus as claimed in claim 1, wherein each cable passes through a guide means held by retractable locking means attached to the surface apparatus, float means attached to the guide means having clamping means through which the cable passes, a stop attached to the end of each cable causing, upon its impact against the said guide means, the release of the latter from the locking means and the jamming of the cable in the clamping means.

3. Apparatus for guiding a load between a surface apparatus and a submerged base platform comprising at least two return pulleys mounted on to the base platform, at least two cables passing over the pulleys, one of the runs of each cable being connected to the surface apparatus by means of a winch wherein movements of the runs passing to the winches are interlocked by clutch means, the other run acting to guide a load-carrier, and means for horizontal levelling of the load-carrier, each run passing from the respective pulley to the respective winch separating from the respective guide run as it extends away from the respective pulley, the runs connected to the load-carrier being orientated by the latter in the direction of the surface apparatus and including a drum on the said surface apparatus for maintaining tensioned a cable attached to the platform and upwardly divergent relative to the guide runs, movement of the cable being interlocked with that of one of the runs passing to the winches by a clutch means.

4. Apparatus as claimed in claim 3, wherein the load-carrier is a positive buoyancy bell.

5. Apparatus for guiding a load between a surface apparatus and a submerged baseplatform comprising at least two return pulleys mounted on to the base platform, at least two cables passing over the pulleys, one of the runs of each cable being connected to the surface apparatus by means of a winch, the other run acting to guide a load-carrier, and means for horizontal levelling of the load-carrier, each run passing from the respective pulley to the respective winch separating from the respective guide runs as it extends away from the respective pulley, the runs connected to the load-carrier being orientated by the latter in the direction of the surface apparatus, and wherein an end of each of the guide runs is attached to the rod of a piston of a cylinder connected to the load-carrier, hydraulic circuit means being provided for controlling the motion of the pistons to trim horizontally the load-carrier.

6. Apparatus for guiding a load between a surface apparatus and a submerged base platform comprising at least two return pulleys mounted on to the base platform, at least two cables passing over the pulleys, one of the runs of each cable being connected to the surface apparatus by means of a winch, the other run acting to guide a load-carrier, and means for horizontal levelling of the load-carrier, each run passing from the respective pulley to the respective winch separating from the respective guide run as it extends away from the respective pulley, the runs connected to the load-carrier being orientated by the latter in the direction of the surface apparatus, and wherein each cable passes through a guide means held by retractable locking means attached to the surface apparatus, float means attached to the guide means having clamping means through which the cable passes, a step attached to the end of each cable causing, upon its impact against the said guide means, the release of the latter from the locking means and the jamming of the cable in the clamping means.

7. Apparatus as claimed in claim 6 wherein the clamping means including a clamping member positioned in its non-clamping position in the path of the guide means after its release, and the retractable locking means includes a finger biased by a spring, the guide means having a wedge-shaped external surface portion to which the finger is applied to retain the guide means, the arrangement being such that on release of the cable and jamming of the stop in the guide means, the wedge-shaped surface portion causes the finger to be retracted to release the guide means and operates the clamping member to move it to a clamping position to clamp the cable.

8. Apparatus as claimed in claim 6, wherein the load-carrier has as many guide paths for the passage of a first cable run as it has traction cables, each run being firmly attached at its end to a stop carrying a locking means, as many catch surfaces for retaining the said stops when the second runs of the said cables are tensioned, and guide surfaces, such that a pick-up tool sliding on one of the said second tensioned cable runs and on to a respective one of the guide surfaces positions itself to fit over the said stop and its locking means, locking on to the latter.

9. Apparatus as claimed in claim 8, wherein each catch surface is formed by a spindle provided with an axial channel for passage of the said cable run and a locking means, such that a pick-up tool sliding on one of the said second tensioned cable runs and on to a respective one of the said guide surfaces positions itself to fit over the said stop, the said spindle and the locking means carried by the latter, locking itself on to it.

* * * * *